US009306257B2

(12) United States Patent
Huynh

(10) Patent No.: US 9,306,257 B2
(45) Date of Patent: Apr. 5, 2016

(54) RF PHASE SHIFT APPARATUS HAVING AN ELECTRICALLY COUPLED PATH SEPARATED FROM AN ELECTROMAGNETICALLY COUPLED PATH TO PROVIDE A SUBSTANTIALLY CONSTANT PHASE DIFFERENCE THEREBETWEEN

(71) Applicant: LitePoint Corporation, Sunnyvale, CA (US)

(72) Inventor: Minh-Chau Huynh, San Mateo, CA (US)

(73) Assignee: LITEPOINT CORPORATION, Sunnyvale, CA (US)

( * ) Notice: Subject to any disclaimer, the term of this patent is extended or adjusted under 35 U.S.C. 154(b) by 0 days.

(21) Appl. No.: 14/243,166

(22) Filed: Apr. 2, 2014

(65) Prior Publication Data

US 2015/0288042 A1 Oct. 8, 2015

(51) Int. Cl.

| | |
|---|---|
| ***H01P 1/18*** | (2006.01) |
| ***H01P 9/00*** | (2006.01) |
| ***H01P 1/10*** | (2006.01) |
| ***H01P 5/02*** | (2006.01) |

(52) U.S. Cl.
CPC *H01P 1/184* (2013.01); *H01P 1/10* (2013.01); *H01P 5/028* (2013.01); *H01P 9/00* (2013.01)

(58) Field of Classification Search
CPC ..... H01P 1/18; H01P 1/184; H01P 9/00
USPC ..... 333/161, 164
See application file for complete search history.

(56) References Cited

U.S. PATENT DOCUMENTS

| | | | | |
|---|---|---|---|---|
| 3,568,098 | A * | 3/1971 | Gerst | 333/116 |
| 6,091,311 | A * | 7/2000 | Waters | 333/161 |
| 7,224,247 | B2 * | 5/2007 | Dean | 333/161 |
| 2013/0076453 | A1 | 3/2013 | Lai et al. | |
| 2013/0099873 | A1 | 4/2013 | Abhaikumar et al. | |

FOREIGN PATENT DOCUMENTS

| | | | |
|---|---|---|---|
| JP | 2003008310 | A | 1/2003 |
| WO | 2008006089 | A2 | 1/2008 |

OTHER PUBLICATIONS

Moghadasi, M. N. et al.; "Compact Ultra-Wideband Phase Shifter"; Progress In Electromagnetics Research Letters, vol. 15, pp. 89-98, 2010.

International Search Report and Written Opinion dated May 28, 2015 relative to PCT/US2015/019103; 11 pages.

* cited by examiner

*Primary Examiner* — Benny Lee
(74) *Attorney, Agent, or Firm* — Vedder Price, P.C.

(57) ABSTRACT

Circuitry for shifting a phase of a radio frequency (RF) signal. Mutually dissimilar and electrically coupled portions of an electromagnetic transmission line pattern on one side of a substrate interact with another electromagnetic transmission line pattern on the opposing substrate side to convey a RF signal with a phase shift that is determined by the RF signal frequency and respective dimensions of the electromagnetic transmission line patterns and is substantially constant over a wide bandwidth. With multiple implementations of such opposing electromagnetic transmission line patterns having different pattern dimensions and coupled between RF signal switches, multiple phase shifts can be selectively provided.

7 Claims, 7 Drawing Sheets

RF PHASE SHIFT APPARATUS HAVING AN ELECTRICALLY COUPLED PATH SEPARATED FROM AN ELECTROMAGNETICALLY COUPLED PATH TO PROVIDE A SUBSTANTIALLY CONSTANT PHASE DIFFERENCE THEREBETWEEN

BACKGROUND

The present invention relates to phase shift circuitry, and in particular, to passive phase shift circuitry providing a substantially constant phase shift over a wide frequency band.

Many of today's electronic devices use wireless signal technologies for both connectivity and communications purposes. Because wireless devices transmit and receive electromagnetic energy, and because two or more wireless devices have the potential of interfering with the operations of one another by virtue of their signal frequencies and power spectral densities, these devices and their wireless signal technologies must adhere to various wireless signal technology standard specifications.

When designing such wireless devices, engineers take extra care to ensure that such devices will meet or exceed each of their included wireless signal technology prescribed standard-based specifications. Furthermore, when these devices are later being manufactured in quantity, they are tested to ensure that manufacturing defects will not cause improper operation, including their adherence to the included wireless signal technology standard-based specifications.

When testing radio frequency (RF) devices and systems in general, and wireless RF devices and systems in particular, there is often a need for shifting the phase of a signal being transmitted or received via a particular signal path. For example, when testing devices using one or more wireless signal paths, such as within a shielded enclosure or another form of controlled signal path environment, one or more antenna elements (e.g., an antenna array) may be used along with phase shifting elements to allow for shifting of signal phases within the one or more signal paths between the signal source and each antenna element so as to mitigate multipath signal interference effects. (Such test enclosures and wireless signal testing techniques are disclosed in U.S. Patent Publications 2014/0266929 and 2014/0266930, the contents of which are incorporated herein by reference.)

A variety of RF signal path structures exist that can produce variable amounts of phase shift. For example, simply having two transmission lines of different lengths will cause the signals conveyed by such lines to experience mutually distinct phase shifts, thereby causing a phase shift of one signal relative to the other. However, simply using a selected length of transmission line will introduce a phase shift that varies as a linear function of signal frequency. Accordingly, a desired amount of phase shift can only be achieved over a very narrow bandwidth.

One technique that has been developed to increase the bandwidth available over a passive transmission line is known as the Schiffman phase shifter design, which uses a transmission line and a coupled section to provide a wider bandwidth over which a desired phase shift can be imparted. However, achieving that wider bandwidth requires tight signal coupling between transmission line elements, which can make implementation difficult.

Another technique that has been developed, often referred to as a compact ultra wideband phase shifter, can achieve a wide phase shift bandwidth (e.g., 3-11 GHz). However, the phase difference is limited to 30 degrees or less.

Accordingly, it would desirable to have a technique for providing selectable amounts of significant phase shift, e.g., 90 degrees or more, over a wide frequency band.

SUMMARY OF THE INVENTION

In accordance with the presently claimed invention, circuitry for shifting a phase of a radio frequency (RF) signal. Mutually dissimilar and electrically coupled portions of an electromagnetic transmission line pattern on one side of a substrate interact with another electromagnetic transmission line pattern on the opposing substrate side to convey a RF signal with a phase shift that is determined by the RF signal frequency and respective dimensions of the electromagnetic transmission line patterns and is substantially constant over a wide bandwidth. With multiple implementations of such opposing electromagnetic transmission line patterns having different pattern dimensions and coupled between RF signal switches, multiple phase shifts can be selectively provided.

In accordance with one embodiment of the presently claimed invention, circuitry for shifting a phase of a radio frequency (RF) signal includes: a substrate formed of an electrical insulator and having mutually opposed first and second sides; a first electrically conductive layer disposed on the first side and including a first electromagnetic transmission line pattern with mutually dissimilar and electrically coupled first and second pattern portions electrically coupled between first and second signal terminals; and a second electrically conductive layer disposed on the second side and including a second electromagnetic transmission line pattern for electromagnetic communication with the second pattern portion.

In accordance with exemplary embodiments, the first pattern portion includes a microstrip structure, and the second pattern portion and second electromagnetic transmission line pattern together include a patch-slot structure.

DETAILED DESCRIPTION OF THE INVENTION

Figure 1:
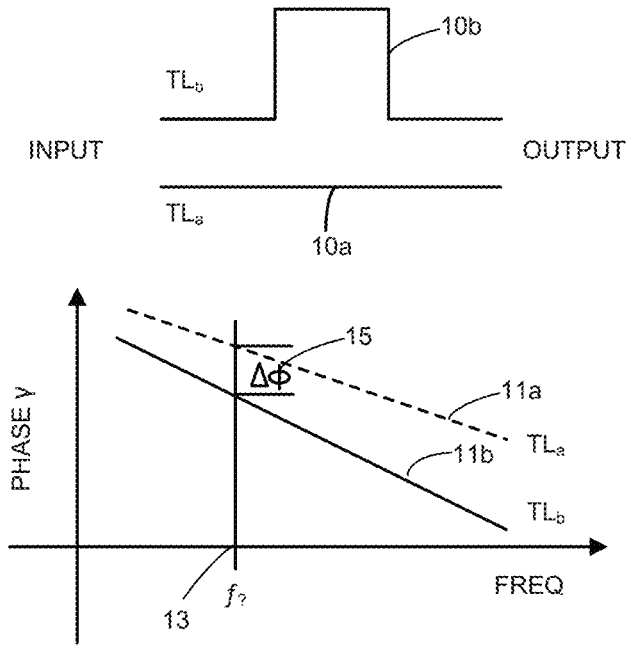
FIG. 1 (PRIOR ART)
FIG. 1 depicts two passive transmission lines of different length and the phase differences imparted by each as a function of frequency.

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together (e.g., as one or more integrated circuit chips) to provide the described function. Additionally, the term "signal" may refer to one or more currents, one or more voltages, or a data signal. Within the drawings, like or related elements will have like or related alpha, numeric or alphanumeric designators. Further, while the present invention has been discussed in the context of implementations using discrete electronic circuitry (preferably in the form of one or more integrated circuit chips), the functions of any part of such circuitry may alternatively be implemented using one or more appropriately programmed processors, depending upon the signal frequencies or data rates to be processed. Moreover, to the extent that the figures illustrate diagrams of the functional blocks of various embodiments, the functional blocks are not necessarily indicative of the division between hardware circuitry.

Wireless devices, such as cellphones, smartphones, tablets, etc., make use of standards-based technologies, such as IEEE 802.11a/b/g/n/ac, 3GPP LTE, and Bluetooth. The standards that underlie these technologies are designed to provide reliable wireless connectivity and/or communications. The standards prescribe physical and higher-level specifications generally designed to be energy-efficient and to minimize interference among devices using the same or other technologies that are adjacent to or share the wireless spectrum.

Tests prescribed by these standards are meant to ensure that such devices are designed to conform to the standard-prescribed specifications, and that manufactured devices continue to conform to those prescribed specifications. Most devices are transceivers, containing at least one or more receivers and transmitters. Thus, the tests are intended to confirm whether the receivers and transmitters both conform. Tests of the receiver or receivers (RX tests) of a device under test (DUT) typically involve a test system (tester) sending test packets to the receiver(s) and some way of determining how the DUT receiver(s) respond to those test packets. Transmitters of a DUT are tested by having them send packets to the test system, which then evaluates the physical characteristics of the signals sent by the DUT.

In general, testing of wireless devices is preceded by the connecting of those devices to their respective test subsystem or system using conductive signal connectors. However, in some instances (e.g., as discussed in the patent applications identified above), the interfaces between the devices and the test equipment include wireless signal paths over which the signals are conveyed electromagnetically. Confined to relatively small electromagnetically shielded enclosures, the test signal interface includes arrays of antenna elements within the enclosure thru which the wireless signals are received or transmitted, with the individual antenna signals adjusted in phase. Such a testing environment using arrays of antenna elements requires a mechanism for shifting signal phases in the respective signal paths between the signal sources and transmitter antenna array elements, or between the receiver antenna array elements and the signal receiving subsystem. Given the operating requirements of the devices, these phase shifters must operate over wide frequency ranges with minimal insertion losses. Further, they must be capable of matching the voltage standing wave ratio (VSWR) of the signal paths to which they are connected to minimize return losses.

Referring to FIG. 1 (depicting slope of signal phase versus frequency for a transmission patch/slot), as noted above, a conventional technique for conveying two RF signals with mutually distinct signal phases uses two transmission lines (TLa) 10*a*, (TLb) 10*b*, with the latter signal path 10*b* being longer. As a result, the phase 11*b* of the signal passing from the input (INPUT) to the output (OUTPUT) through the second path 10*b* will be delayed as compared to the phase 11*a* of the signal passing through the shorter signal path 10*a*. Hence, at a desired signal frequency 13, the difference between the lengths of the signal paths 10*a*, 10*b* can be set such that a desired phase shift $\Delta\phi$ 15 between the two signals is achieved. However, as depicted in the phase $\gamma$ versus frequency graph, for frequencies below the desired frequency 13, the phase shift decreases, while for frequencies above the desired frequency $f_?$ 13, the phase shift increases. Hence, the bandwidth for which the phase shift remains substantially equal to a particular desired shift is narrow.

Figure 2:
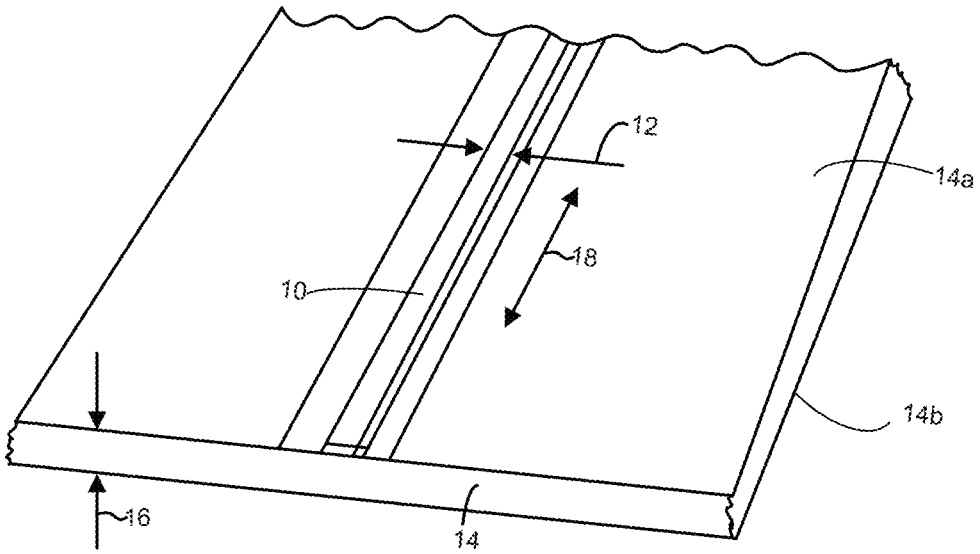
FIG. 2 (PRIOR ART)
FIG. 2 is a perspective view of a conventional microstrip transmission line structure.

Referring to FIG. 2, a common transmission line structure used for such a phase shifter is known as microstrip. In accordance with well-known techniques, a microstrip transmission line structure includes the printed circuit board having a dielectric 14 with top 14*a* and bottom 14*b* surfaces plated with a conductor (e.g., a metal) providing ground planes, and a signal conductor 10 having a width 12 and length 18. The width 12 is determined by the desired line impedance in accordance with the thickness 16 of the substrate 14 and its dielectric constant, while the length 18 is determined by the desired phase shift to be imparted to the signal being conveyed.

Figure 3:
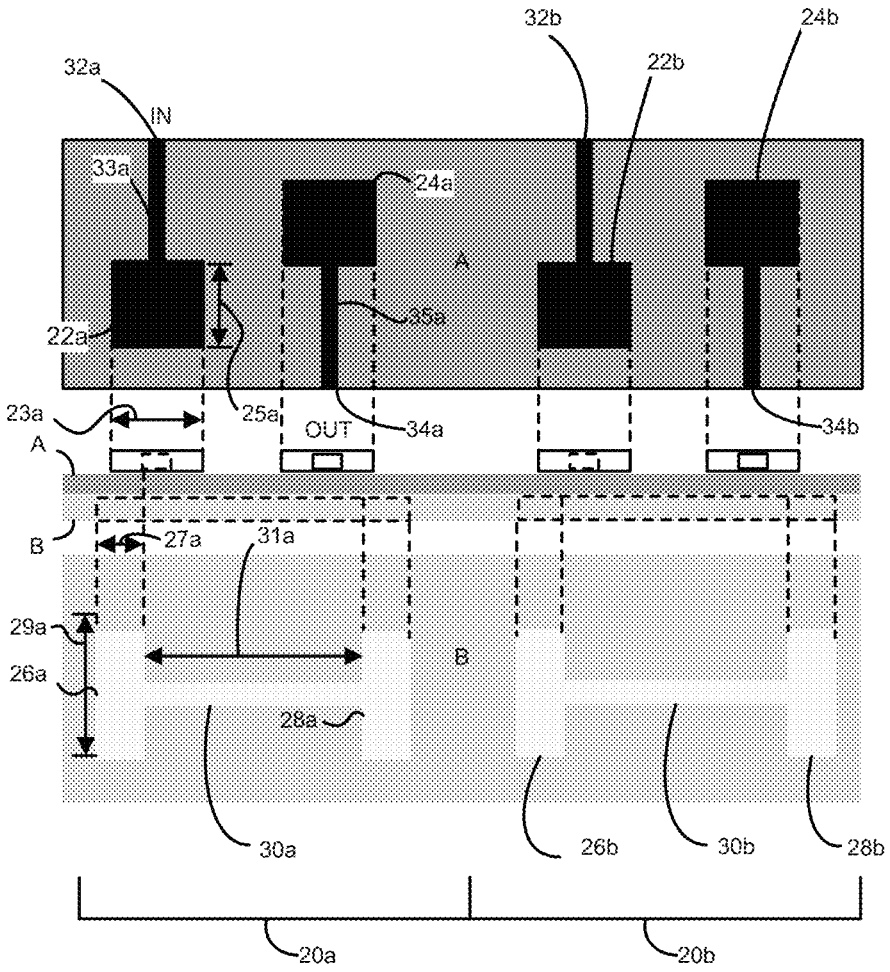
FIG. 3 (PRIOR ART)
FIG. 3 depicts a transmission line structure for a conventional compact ultra wideband phase shifter using a microstrip to slot-line transition technique.

Referring to FIG. 3, as noted above, a compact ultra wideband phase shifter has been implemented using transmission line patch-slot structures. Two such structures 20*a*, 20*b* are depicted here, disposed alongside each other, with input and output transmission line patterns disposed on the top (side A) of a substrate (e.g., a printed circuit board) and coupling transmission line structures disposed on the bottom (side B). In the first structure 20*a*, disposed on one side are input conductive patch 22*a* and output conductive patch 24*a*, each having length dimension 25*a* and width dimension 23*a*, with an input signal port (IN) 32*a* coupled via microstrip 33*a* to the input conductive patch 22*a* and the output conductive patch 24*a* coupled via microstrip 35*a* to an output signal port (OUT) 34*a*. Disposed on the other side, at a substantially mutually opposite location, is an electrically isolated transmission line structure formed by two rectangular conductive patches 26*a*, 28*a* having width dimension 27*a* and length dimension 29*a*, and coupled via microstrip 30*a* having a prescribed length 31*a*. The input signal 32*a* is conducted by the input microstrip line 33*a* and patch 22*a*, coupled to the opposing patch 26*a* where it is conveyed via the microstrip 30*a* to the other opposing patch 28*a*, and coupled back up to the output patch 24*a* where it is conducted via the output microstrip 35*a* to the output port 34*a*. The second structure 20*b* includes similar conductive patches 22*b*, 24*b* coupled via microstrip to an input signal port 32*b* and an output signal port 34*b* on side A, and conductive patches 26*b*, 28*b* coupled via microstrip 30*b* on side B.

Similarly, referring to the adjoining circuit structure 20*b*, a signal entering the input port 32*b* and existing output port 34*b* will experience a phase shift as well. If the various circuit structure dimensions 23*a*, 25*a*, 27*a*, 29*a*, 31*a* are the same, the phase shift will be the same. However, if the dimensions of the second structure 20*b* differ from those of the first structure 20*a*, there will be a phase difference between the two signals existing the output ports 34*a*, 34*b*.

Figure 4:
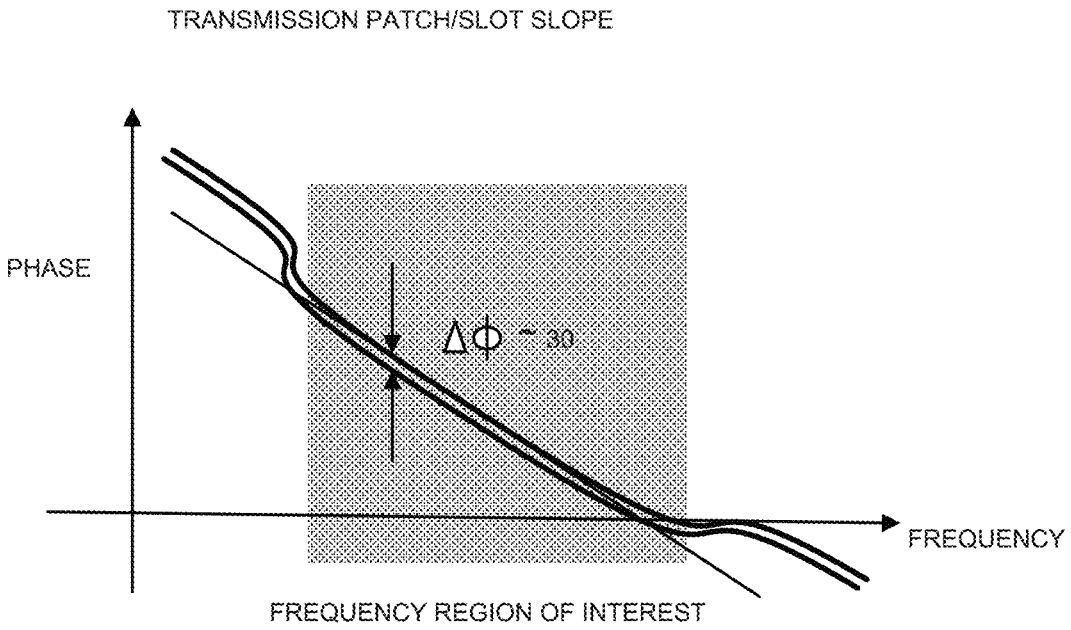
FIG. 4 (PRIOR ART)
FIG. 4 depicts phase shift as a function of frequency for the phase shifter of FIG. 3.

Referring to FIG. 4, in a case where the dimensions of the second structure 20*b* differ from the first structure 20*a*, there is a phase difference $\Delta\phi$ that remains substantially constant over a frequency region of interest. However, as noted above, this phase difference $\Delta\phi$ is limited to approximately 30 degrees.

Figure 5:
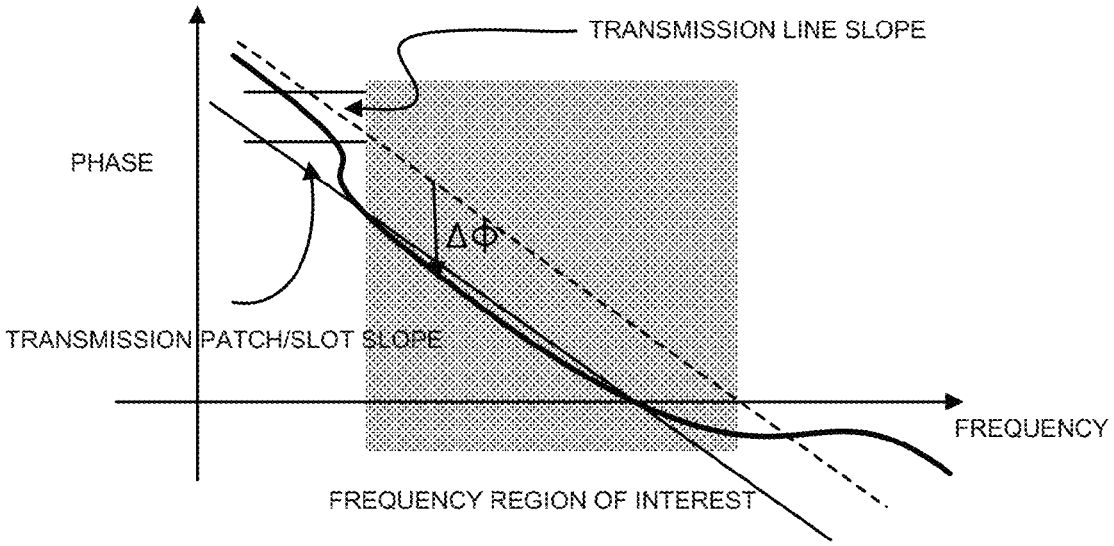
FIG. 5 depicts a phase shift difference as a function of frequency using two passive transmission line structures in accordance with exemplary embodiments of the presently claimed invention.

Referring to FIG. 5, in accordance with exemplary embodiments of the presently claimed invention, such a transmission patch/slot structure and a transmission line can be used together to vary the slope (i.e., phase versus frequency) of a transmission line by using one or more lumped circuit reactances (e.g., discrete capacitances and/or inductors). Accordingly, a transmission line phase slope can be made essentially parallel to the virtually linear portion of the corresponding slope for a transmission patch/slot structure. Thus, the phase difference between the two signals can be maintained at a substantially constant value over a frequency region of interest. In accordance with such exemplary embodiments, this phase difference can be significantly higher than 30 degrees, such as a nominal 90 degrees with a phase variance over the frequency region of interest of +/−20 degrees. Accordingly, fewer phase shifters are needed for a cascaded connection to achieve higher phase shifts.

Figure 6:
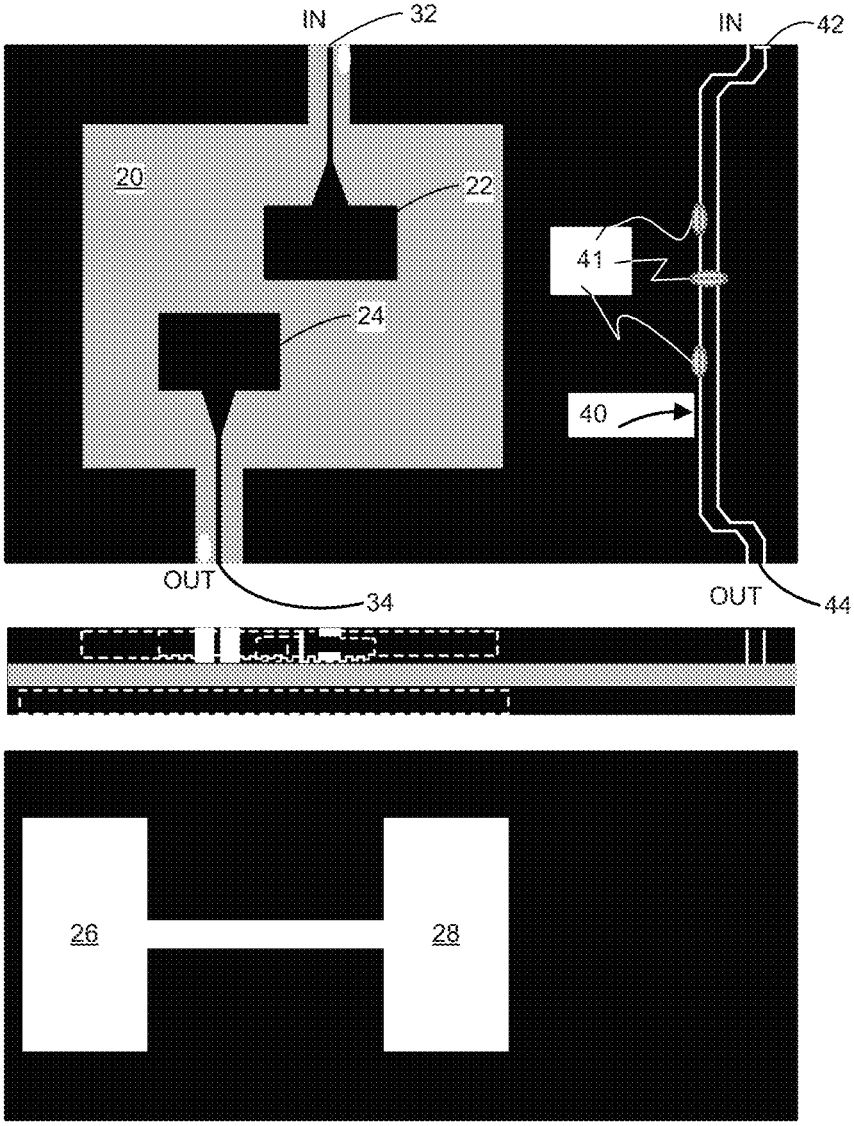
FIG. 6 depicts transmission line phase shift circuitry in accordance with an exemplary embodiment of the presently claimed invention.

Referring to FIG. 6, in accordance with exemplary embodiments, a transmission line pattern in the form of a transmission patch/slot structure 20 (with conductive patches 22, 24 on the top side and conductive patches 26, 28 coupled via microstrip on the bottom side as in FIG. 3) is used in conjunction with a transmission line structure 40 in the form of microstrip on a shared substrate, such as a printed circuit board having a dielectric sandwiched between top and bottom conductors (as discussed above). A signal entering the input port (IN) 42 of the second structure 40 is conveyed by the transmission line 40 to the output port (OUT) 44. Another signal enters the input port (IN) 32 of the first structure 20 and is conveyed to the output port (OUT) 34 with a phase shift such that the output signal of the first pattern 20 has a phase shift of 90 plus/−20 degrees as compared to the signal at the output port 44 of the second pattern 40. This phase shift is maintained within this variance over a frequency range of 800 MHz to 8 GHz, with an insertion loss of 1 dB or less, and a return loss of +10 dB or more.

Differences in phase shift between the first circuit structure 20 and second circuit structure 40 can be compensated using techniques well known in the art, such as including lumped circuit elements, such as lumped capacitances and/or inductances in the form of a network 41 such as a T-network (two shunt circuit reactances of a first type separated by a serial reactance of a second type) or a $\pi$-network (a shunt reactance of a first type connected between two serial reactances of a second type).

Figure 7:
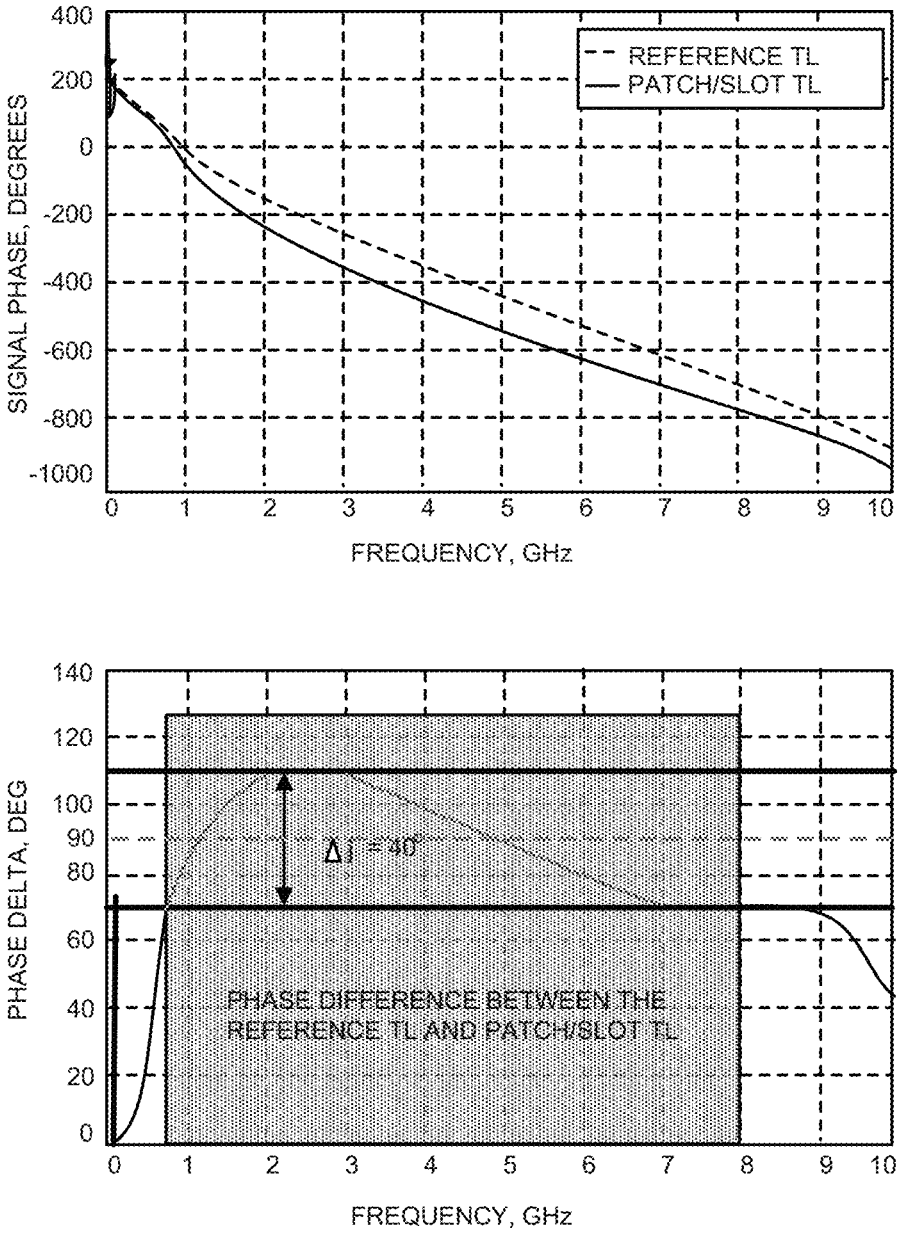
FIG. 7 depicts signal phase versus frequency of the phase shift circuitry of FIG. 6.

Referring to FIG. 7, in accordance with exemplary embodiments, circuit structures in accordance with those depicted in FIG. 6 can be implemented such that the second transmission line structure 40 (microstrip) can have a slope (signal phase or phase delta in degrees versus frequency in GHz) substantially parallel to that of the transmission patch/slot structure 20, with a phase variance between the two structures of +/−20 degrees or less, e.g., between 70 degrees and 110 degrees over a frequency range of 800 MHz to 8 GHz, which for many applications is an acceptable phase variance. (The upper graph depicts signal phase (degrees) versus frequency (GHz) for the reference transmission line (TL) and patch/slot transmission line (TL), and the lower graph depicts signal phase delta (degrees) versus frequency (GHz) between the reference transmission line (TL) and patch/slot transmission line (TL).)

Figure 8:
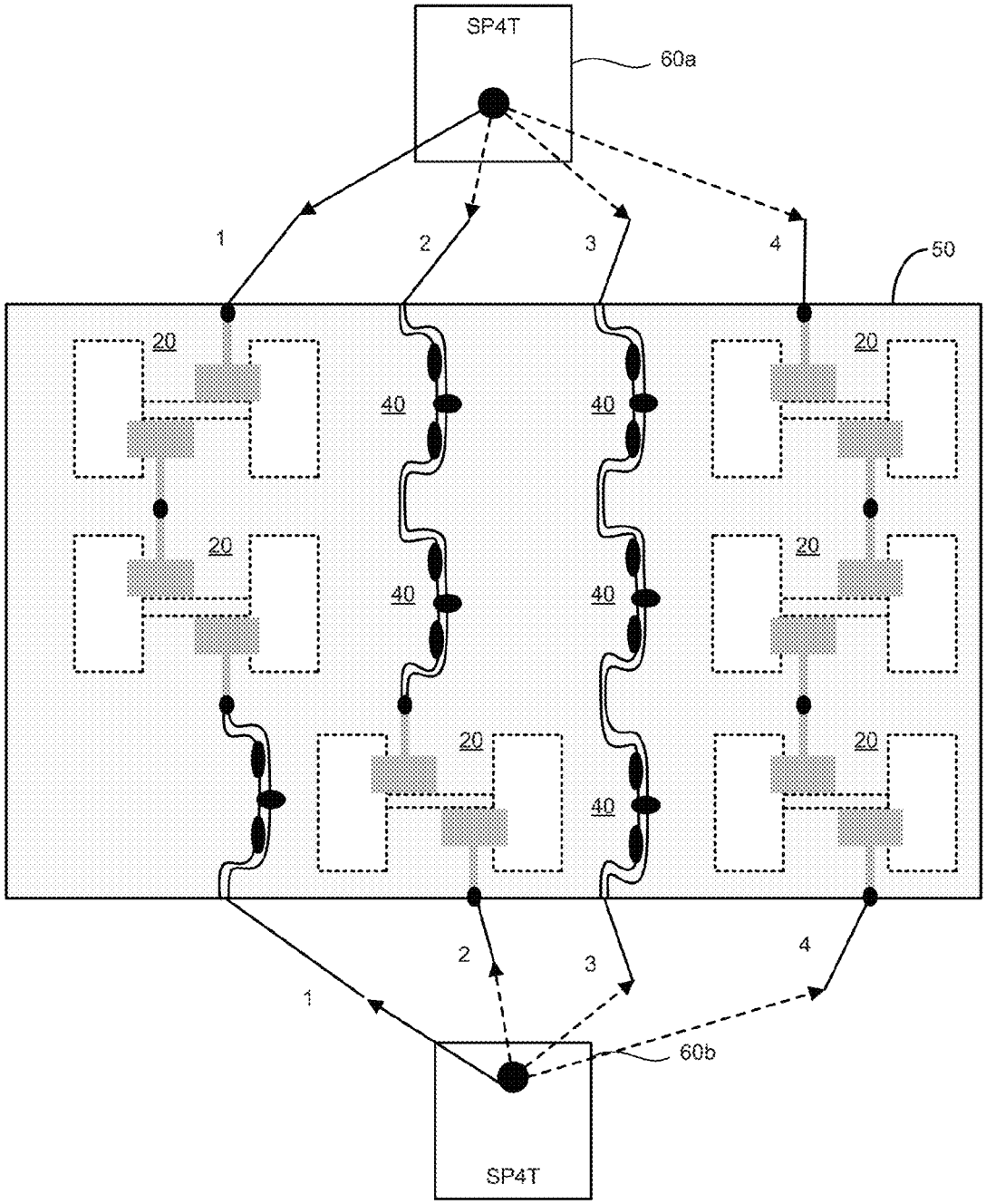
FIG. 8 depicts multiple transmission line phase shift circuits in accordance with exemplary embodiments implemented as a phase shift structure providing selectable phase shifts.

Referring to FIG. 8, in accordance with exemplary embodiments, multiple instances of the transmission line patterns 20, 40 (FIG. 6) can be used to form a circuit structure 50 having multiple possible phase shifts. (For this example, four possible phase shifts are provided, though it will be readily understood that more or fewer phase shifts can be included using various combinations of the transmission line patterns 20, 40.) For example, this structure 50 provides nominal phase shifts of 180, 90, 0 and 270 degrees (left to right) by switching the signal routing circuits 60*a*, 60*b* (e.g., in the form of single pole, four throw (SP4T) switches) among the four signal paths 1, 2, 3, 4.

Various other modifications and alternations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including circuitry for shifting a phase of a radio frequency (RF) signal, comprising:

a substrate formed of an electrical insulator and having mutually opposed first and second sides;

first, second, third and fourth electrical signal terminals disposed on said substrate;

a first electrically conductive layer disposed on said first side and including a first electromagnetic transmission line pattern with mutually dissimilar and electrically separate first and second pattern portions, wherein said first pattern portion electrically couples said first and second electrical signal terminals, and said second pattern portion electromagnetically couples said third and fourth electrical signal terminals; and a second electrically conductive layer disposed on said second side and including a second electromagnetic transmission line pattern for electromagnetic communication with said second pattern portion.

2. The apparatus of claim 1, wherein said second pattern portion and said second electromagnetic transmission line pattern are disposed at substantially mutually opposite locations.

3. The apparatus of claim 1, wherein said second pattern portion and said second electromagnetic transmission line pattern together comprise a patch-slot structure.

4. The apparatus of claim 1, wherein said first pattern portion comprises a microstrip structure.

5. The apparatus of claim 1, further comprising fifth, sixth, seventh and eighth electrical signal terminals disposed on said substrate, and wherein:

said first electrically conductive layer further includes a third electromagnetic transmission line pattern with mutually dissimilar and electrically separate third and fourth pattern portions, wherein said third pattern portion couples said fifth and sixth electrical signal terminals, said fourth pattern portion couples said seventh and eighth electrical signal terminals, and at least a portion of said fourth pattern portion is similar to at least a portion of said second pattern portion; and said second electrically conductive layer further includes a fourth electromagnetic transmission line pattern for electromagnetic communication with said fourth pattern portion, wherein at least a portion of said fourth electromagnetic transmission line pattern is similar to at least a portion of said second electromagnetic transmission line pattern.

6. The apparatus of claim 5, wherein a RF signal conveyed via said first and third electromagnetic transmission line patterns experiences mutually distinct RF signal phase shifts.

7. The apparatus of claim 5, further comprising:

first RF signal switch circuitry coupled to said first and third electrical signal terminals; and second RF signal switch circuitry coupled to said second and fourth electrical signal terminals.

* * * * *